United States Patent [19]

Matsui

[11] Patent Number: 4,914,273

[45] Date of Patent: Apr. 3, 1990

[54] HAIR PROCESSING APPARATUS UTILIZING A PLURALITY OF INFRARED UNITS POSITIONABLE ABOUT THE HEAD

[75] Inventor: Tadateru Matsui, Osaka, Japan

[73] Assignee: Takara Belmont Co., Ltd., Osaka, Japan

[21] Appl. No.: 56,262

[22] Filed: May 26, 1987

Related U.S. Application Data

[63] Continuation of Ser. No. 910,332, Sep. 19, 1986, abandoned, which is a continuation of Ser. No. 631,084, Jul. 16, 1984, abandoned.

[30] Foreign Application Priority Data

Dec. 16, 1983 [JP] Japan ..... 58-192857[U]

[51] Int. Cl.[4] ..... H05B 1/02; H05B 1/00; A45D 20/00; F26B 3/30

[52] U.S. Cl. ..... 219/222; 34/3; 34/4; 34/96; 34/97; 132/206; 132/212; 219/347; 219/354; 219/358

[58] Field of Search ..... 34/3, 4, 96–101, 34/243 R; 132/7, 9, 11 R, 206, 212; 219/343, 347, 348, 354, 358, 377

[56] References Cited

U.S. PATENT DOCUMENTS

| | | | |
|---|---|---|---|
| 1,787,251 | 12/1930 | Jancke et al. | 34/99 |
| 2,500,872 | 3/1950 | Root et al. | 219/354 X |
| 3,867,948 | 2/1975 | Kallemborn | 219/354 X |
| 4,256,127 | 3/1981 | Tsujimoto et al. | 132/212 |
| 4,258,731 | 3/1981 | Tsujimoto et al. | 132/212 |
| 4,259,566 | 3/1981 | Kobayashi | 219/222 |
| 4,265,029 | 5/1981 | Jenkins | 34/39 |
| 4,292,985 | 10/1981 | Itogawa et al. | 132/272 |

FOREIGN PATENT DOCUMENTS

| | | | |
|---|---|---|---|
| 898979 | 7/1944 | France | 219/354 |
| 932187 | 11/1947 | France | 219/354 |
| 944623 | 11/1948 | France | 219/354 |
| 1158364 | 1/1958 | France | 219/354 |
| 1261383 | 4/1961 | France | 219/354 |
| 8300606 | 3/1983 | Norway | 219/222 |
| 604606 | 9/1978 | Switzerland | 219/354 |
| 611663 | 11/1948 | United Kingdom | 132/7 |
| 773514 | 4/1957 | United Kingdom | 219/354 |
| 995503 | 8/1951 | Zaire Zaire | 132/9 |

*Primary Examiner*—Anthony Bartis
*Attorney, Agent, or Firm*—Stephen E. Feldman

[57] ABSTRACT

An infrared hair dryer has four infrared units positionable about the head. Two of the infrared radiating units are fixedly mounted to the top of a framework by a pair of conduits. Side infrared radiating units are mounted to each side of the framework by adjustable means to facilitate positioning of the side units relative to the head of a person whose hair is being dried. Each unit includes an infrared radiator of straight line configuration disposed between a reflecting mirror and a wire screen. A control panel with control circuitry is carried by the framework for relative positioning with respect therefore and is connected to the radiators by electrical conductor means which extend through the conduits. A sensor and indicator are carried by the framework as is a motorized blower unit for blowing air through appropriately formed louvers and towards selected locations. The heat sensor is adjustably mounted to serve as a reference point in adjusting the infrared units.

3 Claims, 5 Drawing Sheets

FIG.5
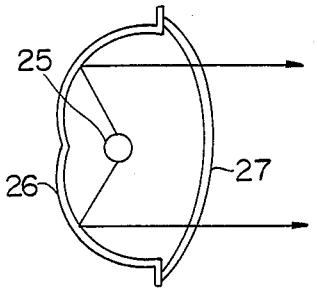
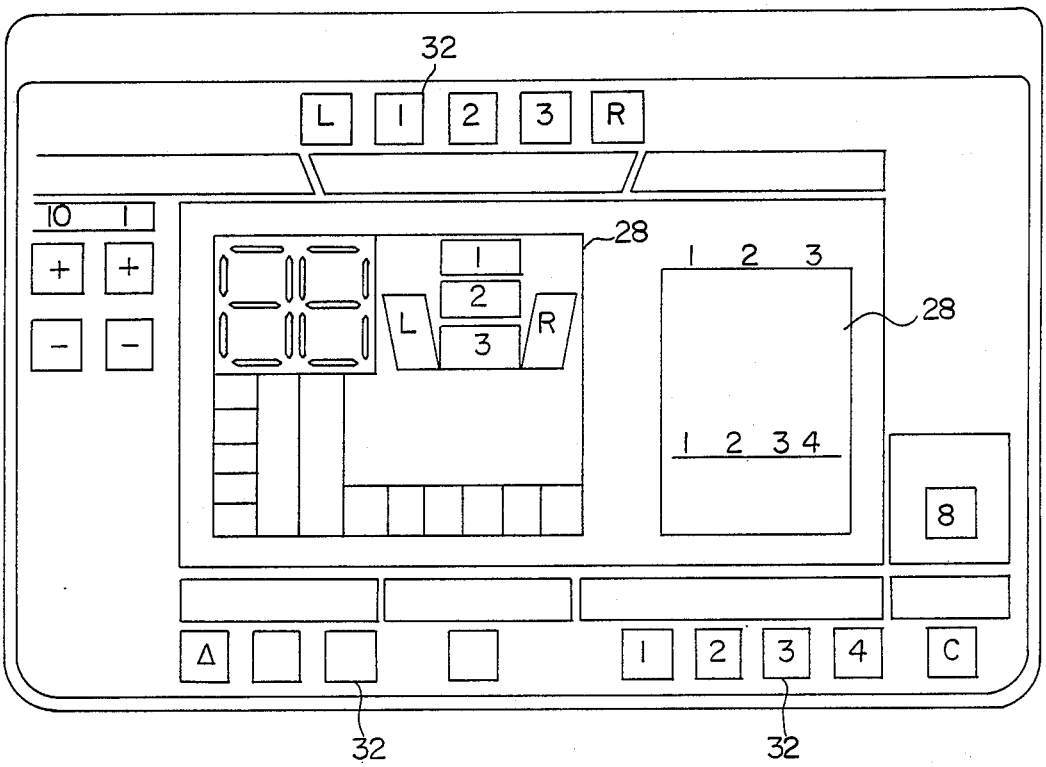
FIG.6

HAIR PROCESSING APPARATUS UTILIZING A PLURALITY OF INFRARED UNITS POSITIONABLE ABOUT THE HEAD

RELATED APPLICATION

This is a continuation of abandoned U.S. patent application Ser. No. 910,332, filed Sept. 19, 1986, which in turn was a continuation of application 631,084 filed July 16, 1984, now abandoned.

This invention relates to hair heat processing apparatus of the infrared ray type. More particularly, this invention is concerned with a hair drying apparatus having four infrared heating units positionable about the head and heat sensing and control means to assure that overheating of the head does not occur.

BACKGROUND

Hair processing apparatus, otherwise sometimes referred to as hair heat processing apparatus, are utilized today to heat and dry a person's hair. Such heating and drying is usually required during or after the hair has been processed such as perming, or while it is being worked such as drying, costs and the like. The apparatus includes first, second, third and fourth infrared radiating units, a control for controlling operation of the infrared units, an extendable heat sensor usable as a reference point for adjusting the position of certain of the infrared units relative to the head, a blower supplying a stream of air to promote drying and a support stand for supporting the components of the apparatus. Certain of the infrared units are independently positionable while others are positioned with the common framework. Heat sensors positioned adjacent to but spaced from the hair prevent overheating of the hair by the infrared units.

Some hair processing or heat processing apparatus utilize infrared rays for heating and drying the hair. Conventionally available infrared hair processing devices often incorporate an infrared radiator in the form of an elongated pipe of silica glass that is energized to generate heat and radiates far infrared rays. These devices maybe formed so that the heat radiating member and a reflecting mirror, have a curved configuration. By doing so the distance between the device and the hair being processed may be made uniform at the center and at the opposite ends of the infrared ray radiator.

Utilizing such conventionally available hair processing apparatus, however, requires that the person's head be accurately positioned, and that it not be moved while the hair is being processed. Thus the person, who must keep their head so accurately positioned, may become fatigued and otherwise uncomfortable.

SUMMARY OF THE INVENTION

This invention involves infrared radiating hair processing apparatus, and contemplates utilizing a number of infrared radiating units each of straight line construction and configuration, and each contained in an independent case but carried on a common framework. The independent cases are of common structure and are connected to each other by conduits thus greatly reducing manufacturing costs and the like. Certain of the infrared radiating units are independently positionable while others of the infrared radiating units are positioned with the common framework. Heat sensors positioned adjacent to but spaced from the hair prevent over heating the hair by the infrared radiating units.

including a first, second, third and fourth infrared radiating means, a control means for controlling the radiating means, an extendable heat sensor, and the use of the heat sensor as a reference point for adjusting the position of the radiating means relative to the person's head, a blower means, and a support stand.

BRIEF DESCRIPTION OF THE DRAWINGS

In the drawings:

FIG. 5 is a vertical sectional view of a radiator unit of the apparatus of FIGS. 1 and 2; and FIG. 6 is a plain view of an operation panel of the apparatus of FIGS. 1 and 2.

DESCRIPTION OF THE PREFERRED EMBODIMENT

Figure 1:
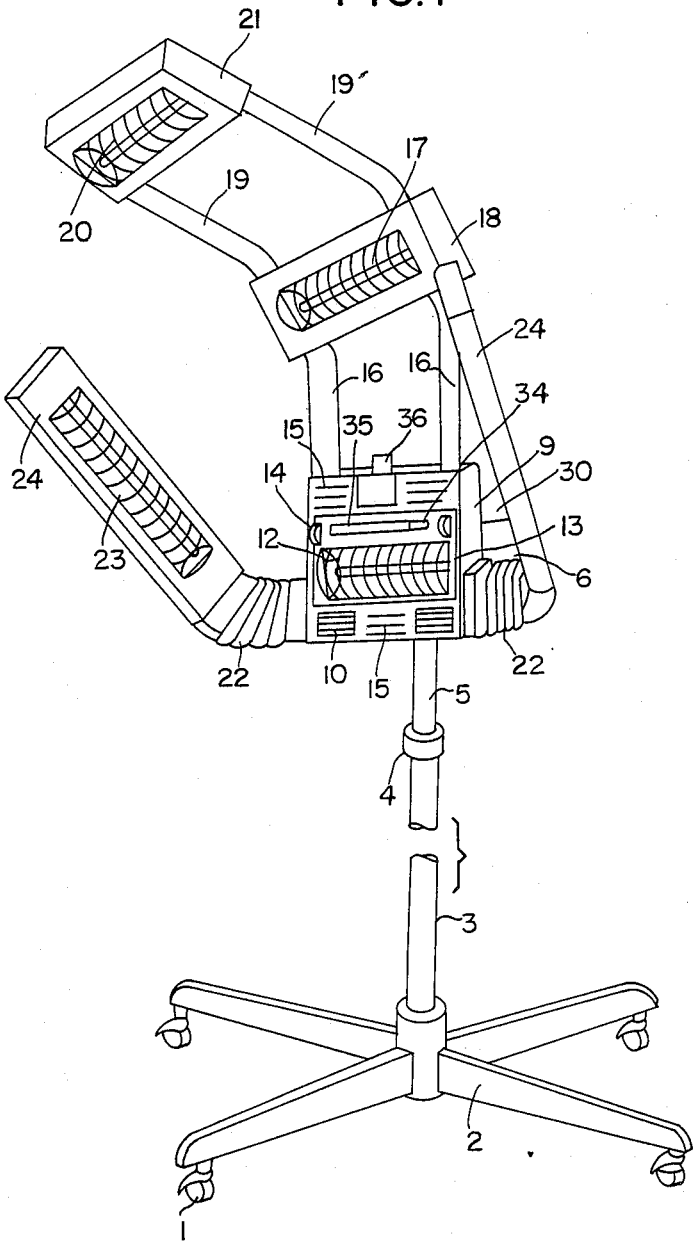
FIG. 1 is a perspective view, of an infrared hair processing apparatus incorporating the instant invention, as viewed from the front of the apparatus.
Figure 2:
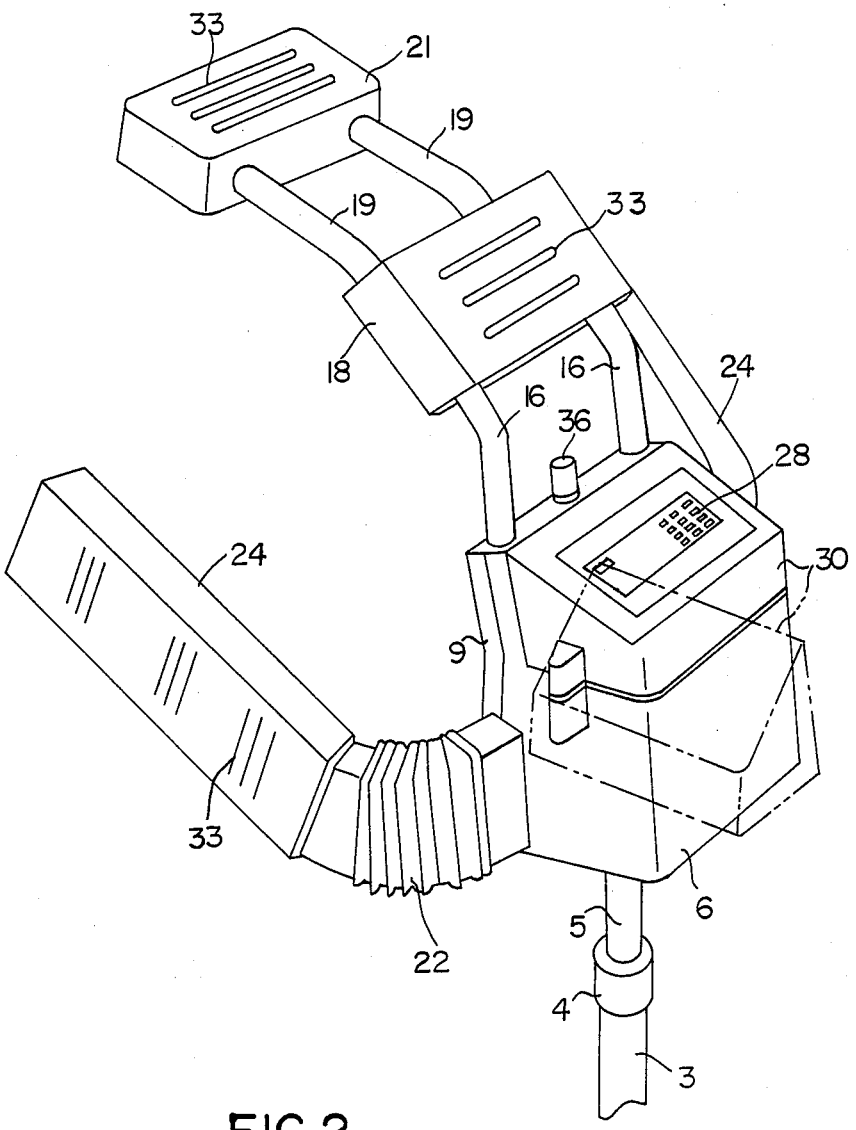
FIG. 2 is a perspective view of the apparatus of FIG. 1 as viewed from the rear of the apparatus.

With reference to FIGS. 1 and 2 there is generally shown a hair processing apparatus incorporating the instant invention and which includes a framework mounted in top of a main post 5 which is, in turn, mounted to and received by a main pipe 3. Pipe 3, and post 5, extend vertically up from the center of a base including a plurality of legs 2 each having a caster 1 mounted at an end thereof. An adjustment nut 4, provided on top of pipe 3, when loosened, permits post 5 to slide within pipe 3 and to be rotated therewithin to adjust the height of framework 6 up and down the positioning thereof. When nut 4 is tightened, post 5 is prevented from movement within pipe 3.

While FIGS. 1 and 2 show framework 6 disposed upon a movable base, it should be understood that framework 6 and the apparatus associated therewith may just as easily be securely suspended from a ceiling or securely mounted on a wall. Appropriate and conventional mounting structure would be utilized to so mount framework 6 in a thus relatively fixed position. Obviously conventional means would be provided for such a mounting to permit height and rotational adjustment of framework 6 and its associated apparatus.

Framework 6 has accommodated therein an air blower 7 (FIG. 3) and a motor 8 for rotating blower 7, and an air outlet pipe 11 which is opened to louvers 10 (FIGS. 2 and 3) of a front cover 9 mounted on the front of framework 6.

Front cover 9 (FIG. 2) has a hole 13 (FIG. 3) perforated therein in which a radiator unit 12 (FIGS. 1 and 3) is accommodated such that the direction thereof can be adjusted upwardly and downwardly within an angle of about 10 degrees by operation of a semicircularly protruding knob 14. Front cover 9 further has air flow louvers 15 provided therein which allows an air flow to pass therethrough to cool radiator unit 12.

A pair of pipes 16 (FIGS. 1–3) extend erectly from the top of front cover 9. A head rear top case 18, in which a radiator unit 17 is accommodated, is mounted at upper ends of the pipes 16. Another pair of pipes 19 extend erectly from the head rear top case 18. A head front top case 21, in which a further radiator unit 20 is accommodated, is mounted at upper ends of the pipes 19. Thus, infrared rays may be radiated to a front top portion and a rear top portion of a person's head from radiator units 17 and 20.

A pair of connecting members 22, having a rectangular cross section, are mounted on opposite left and right sides of framework 6. A side case 24 is mounted for rotation on an end of each of the connecting members 22 such that the direction of a further radiator 23, (FIG. 1) mounted on each connecting member 22 and directed downwardly at an angle of 10 degrees, can be changed further downwardly by an angle of 20 degrees from this position.

Each of the radiator units 12, 17, 20, and 23 includes a heat radiating member 25 (FIG. 3) having a linear silica glass pipe and a heating wire, which is contained in the pipe, and is energizable to generate heat in order that infrared rays of far infrared rays may be radiated from the silica glass pipe. A reflecting mirror 26, having a cross section approximated to a parabola for reflecting infrared rays or far infrared rays radiated from radiating members 25, is carried by units 12, 17, 20 and 23.

A wire screen 27 (FIGS. 3 and 4) for protecting heat radiating member 25 and reflecting mirror 26, and for preventing soiling of reflecting mirror 26 and possible burning of the skin of a person from an inadvertent touch with the heat radiating member 25, is appropriately positioned on units 12, 17, 20 and 23.

A movable arm 35 (FIGS. 11 and 3), having a temperature sensor 34 (FIG. 3) mounted at one end thereof, is mounted at its other or a base end for pivotal motion on front cover 9. The mounting of arm 35 is such that it can be moved from a position adjacent front cover 9 to a position extending therefrom and in which temperature sensor 34 is located on an extension of a center line of front cover 9.

Thus, if movable arm 35 is moved, as described just above, to bring temperature sensor 34 to a position near a rear portion of a head of a person, then all radiator units 12, 17, 20 and 23, once appropriately positioned, will be spaced from the person's head by an equal distance.

A further warning indicator member 36 (FIGS. 1, 2, and 4) is provided at the top of front cover 9 and has a bulb contained therein which is energized simultaneously with energization of heat radiating members 25 to radiate light and thus indicate that heat radiating members 25 are now generating heat. Consequently, the person can be prevented from touching and, being burnt by the heat radiating members 25 without recognizing that the heat radiating members 25 are generating heat.

Figure 3:
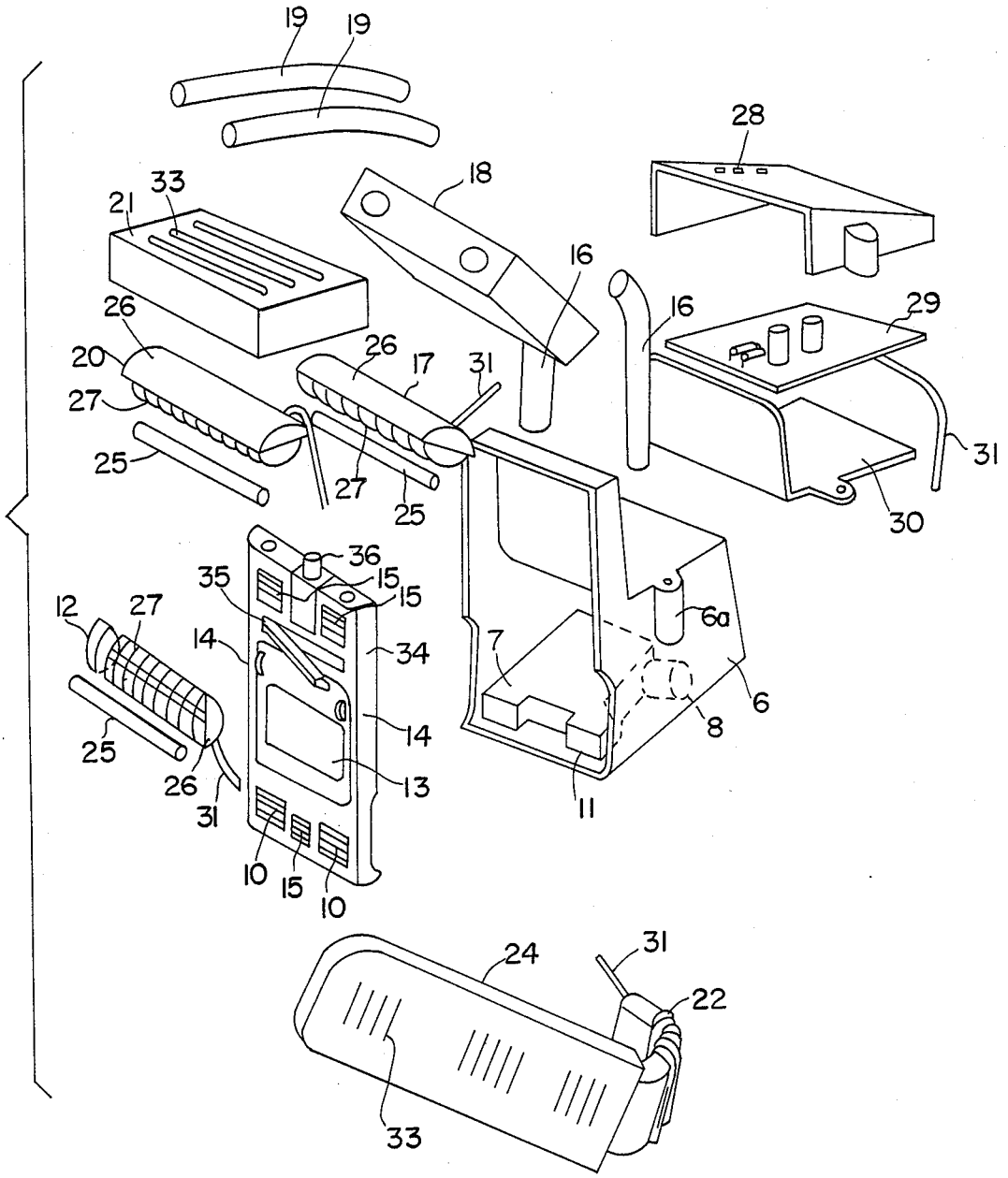
FIG. 3 is a perspective view of the apparatus of FIGS. 1 and 2 but showing same in a disassembled condition.
Figure 4:
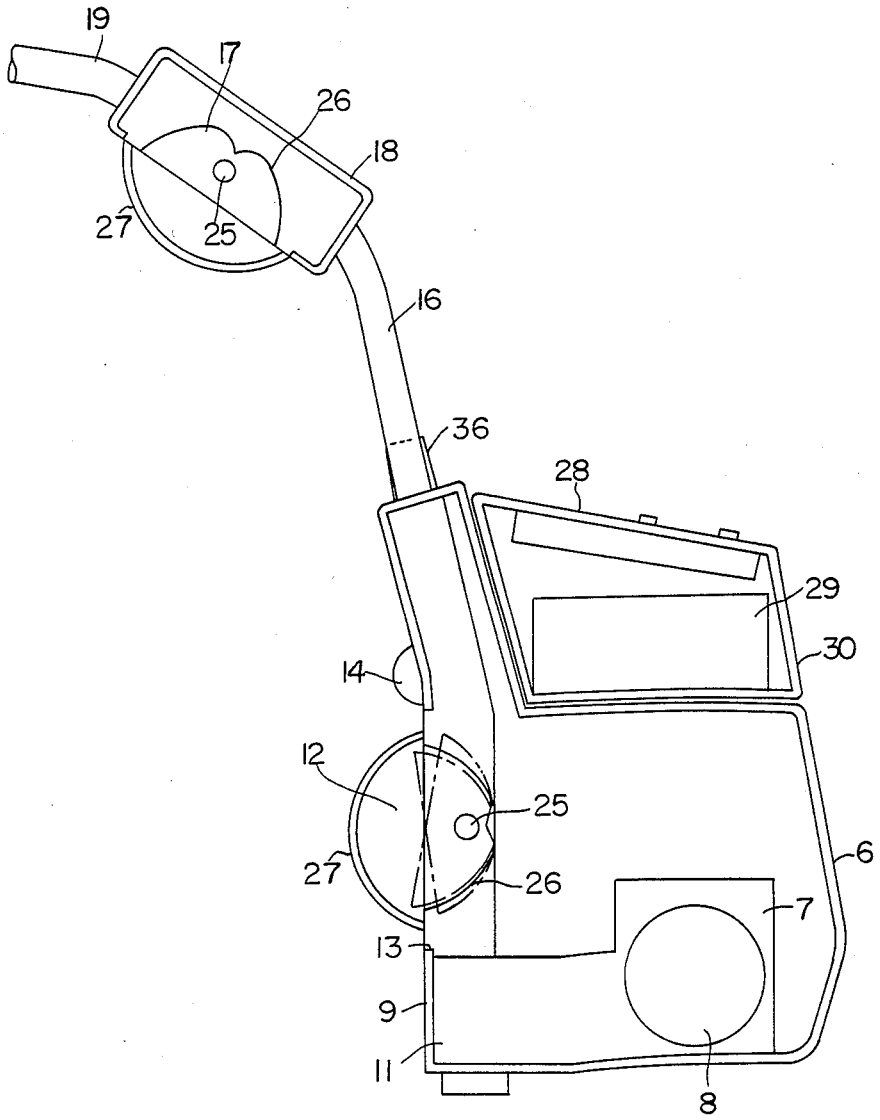
FIG. 4 is a vertical sectional view of a portion of the apparatus of FIGS. 1 and 2.

Framework 6 has a hinge portion 6*a* FIG. 3) protruding from one of the side faces thereof. A control unit 30 is mounted at a side portion thereof for pivotal motion on hinge portion 6*a* of the framework 6. Control unit 30 has a number of controlling switches 28 (FIGS. 2, 4, and 6) thereon and contains a control circuit 29 (FIG. 3) which is responsive to operation of switches 28 for controlling the duration of flow of electric current flowing through heat radiating members 25, and so on.

Thus, control unit 30 can be positioned to a position above an upper face of framework 6 to allow switches 28 thereon to be operated from behind the hair processing apparatus, or unit 30 can be pivoted sidewardly of framework 6 to allow switches 28 to be operated from the front side of the hair processing apparatus. Accordingly, operations for controlling the hair processing apparatus are possible from various positions around framework 6, depending upon the position of the hair processing apparatus relative to a floor and a wall or walls.

An electrical conductor 31 extends from control circuit 29 through pipes 16 and 19 and connects radiation units 17 and 20 to control circuit 29. Conductor 31 also extends through connecting members 22 and connects radiator units 23 to control circuit 29. Accordingly, the electric conductor 31 cannot be observed from outside, thus preventing deterioration of the appearance of the hair processing apparatus.

Thus, when the hair processing apparatus which has such a construction as described above is actually used, it is moved in an arbitrary position by means of the casters 1 and legs 2. Nut 4 is loosened to adjust the hair processing apparatus relative to the height of the head of a person whereafter it is tightened to fix the apparatus again in the thus adjusted position.

Then, the head of the person is observed: from between framework 6 and head rear top case 18; between head rear top case 18 and head front top case 21; from between pipes 16 and pipes 19; and from above and below side cases 24. The person head may then be set in position so that it may be illuminated uniformly over the hair thereof by infrared rays from radiator units 12, 17, 20 and 23. Then, the directions of radiator unit 12 and 17 for the head rear portion and radiator units 23 for the head side portions are adjusted upwardly or downwardly depending upon the length of the hair at such positions.

Subsequently, switches 28, as shown in FIG. 6, are selectively operated depending upon the permanent set, drying of the hair washed; the mode at which hair is to be dyed, intensity of cold liquid used, conditions of the hair such as thickness, degree of damage, water absorbing power, and so on. Such operation of switches 28 can be recognized from lighting of indicating lamp 32 on the indicator panel.

In response to such selective operations of switches 28, heat radiating members 25 are energized to radiate infrared rays which are directed towards the hair to heat and dry the hair. The duration of such energization of heat radiating members 25 is controlled in accordance with an established program which is determined in response to operations of switches 28. At the same time, motor 8 is energized to operate air blower 7 so that streams of air are blown out from louvers 10 against the hair to promote drying of the same.

The temperature of the hair is detected by temperature sensor 34, positioned adjacent the rear portion of the head and, if it rises above a predetermined level, then circuit 29 operates to interrupt the electric current to heat radiating members 25 thereby preventing damage to the hair due to overheating.

Hot air heated by radiation of infrared rays from heat radiating members 25 and also by flowing air as described above, escapes upwardly from between pipes 16 and 19, thereby eliminating a disagreeable feeling that the head is steamed, also promoting drying of the hair.

A rise of temperature in the interior of framework 6, head rear top case 18, head front top case 21 and side cases 24 is inhibited due to the fact that air is circulated through air circulating louvers 15 and 33 perforated in those components. Thus, they can be prevented from overheating.

Further, since air coming through louver 10 is directed to near the ears of a person, the ears which are heated by infrared rays are cooled by the air where the person has a hair style in which the ears are exposed, thus moderating a possible disagreeable feeling of the person. Besides, where the person has long hair, radiator units 12 and 23 may be directed downwardly, while on the contrary where the person has short hair, they may be directed upwardly so that infrared rays may be illuminated uniformly on the entire hair irrespective of the length of the hair.

In addition, since side cases 24 are each arranged such that radiator units 23 thereon are inclined to have the front end thereof located upwardly, the heat radiating members 25 thereof are positioned to extend along a border of the hair. Accordingly, infrared rays illuminated on a face of a person are reduced in quantity when compared with a hair processing apparatus of the horizontally installed type, thereby reducing a disagreeable feeling of the person arising from the fact that the face is heated, the eyes become fatigued by infrared rays, and so on.

As apparent from the foregoing description, according to a hair processing apparatus of the present invention, a heat radiating member has a straight line configuration, and a radiator unit which reflects infrared rays radiated from the heat radiating member also has a straight line configuration. Accordingly, when compared with a conventional hair processing apparatus which includes a radiator unit having a curved configuration extending around a head of a person, according to the hair processing apparatus, the distance from the head to the heat radiating member or to the radiator unit is seldom varied extremely even if the position of the head varies.

Accordingly, there is no obstacle even if the head is moved to some extent during processing, and hence fatigue of a person who undergoes processing can be reduced and the degree of freedom of reading and the like can be increased.

Further, since radiator units provided for a head front top portion and a head rear top portion are contained in independent cases and connected to a framework by means of pipes, a sufficient spacing can be provided for the head of a person. Accordingly, removal of steam and circulation of air can be assured, sufficiently promoting drying of hair, and since the head can be thus observed well, the positioning of the head can be advantageously attained easily.

Moreover, since a common component can be used for a head front top case and a head rear top case and such components are connected to each other by means of pipes, dies can be made small and hence an investment for such dies can be reduced, thus resulting in effective reduction of the cost for the entire apparatus.

In addition, since an electric wire from the control unit is passed through those pipes, the hair processing apparatus is advantageous in that the electric wire is not exposed outside and hence the appearance of the apparatus is not impaired by the electric wire.

As various possible embodiments might be made of the invention, and as various changes might be made in the embodiments above set forth, it is to be understood that all matters herein described and shown in the accompanying drawings are to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention. Coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, intended, in the appended claims, to cover all such changes and modifications as fall within the true spirit and scope of the invention, and it is understood that, although I have shown the preferred form of my invention, various modifications may be made in the details thereof, without departing from the spirit of the invention comprehended by the following claims.

I claim:

1. Apparatus for processing hair on the head of a person, said apparatus including:

(a) a framework;

(b) mounting means for supporting said framework, said mounting means including adjustable means operable selectively positioning said framework vertically, and accurately relative to the person's head;

(c) first infrared radiating means adjustably carried by said framework for heating hair on one side of the person's head, said first infrared radiating means being independently positionable with respect to the one side of the person's head and said framework;

(d) second infrared radiating means carried by said framework for heating hair on the other side of the person's head, said second infrared radiating means being independently positionable with respect to the other side of the person's head and said framework;

(e) third infrared radiating means fixedly carried by said framework for heating hair on the back and top of the person's head, said third infrared radiating means being positionable with said framework;

(f) fourth infrared radiating means carried by said framework and above third infrared radiating means for heating hair on the top of the person's head, said fourth infrared radiating means being fixed with respect to said third infrared radiating means and positionable with said framework;

(g) control means carried by said framework for controlling said first, second, third and fourth infrared radiating means individually and collectively, said control means including a heat sensor carried by a support means extendable from said control means so as to be fixedly juxtapositioned in closely spaced proximity to the rear portion of the head of the person, said sensor when so supported serving as a reference point for adjusting the position of said first, second, third and fourth infrared radiating means relative to the person's head, and means responsive to said head sensor for turning off said first, second, third and fourth infrared radiating means collectively in response to said heat sensor sensing at least a predetermined temperature of the hair.

2. The apparatus of claim 1 including: blower means carried by said framework and positionable with said framework for blowing air toward the head of the person and circulating air in the region of the person's head.

3. The apparatus of claim 1 wherein said mounting means is floor mounted and includes a vertical member coupled to said framework and a plurality of legs extending from said vertical member and providing stability to said apparatus, each leg having a caster.

* * * * *